US005412455A

United States Patent [19]

Ono et al.

[11] Patent Number: 5,412,455

[45] Date of Patent: May 2, 1995

[54] CHARGING DEVICE, IMAGE FORMING APPARATUS AND DETACHABLY MOUNTABLE PROCESS CARTRIDGE HAVING A CONSTANT VOLTAGE POWER SOURCE FEATURE

[75] Inventors: Kazuaki Ono; Koichi Tanigawa, both of Tokyo; Akihiko Takeuchi, Yokohama; Hajime Motoyama, Kawasaki; Toshio Miyamoto, Yokohama, all of Japan

[73] Assignee: Canon Kabushiki Kaisha, Tokyo, Japan

[21] Appl. No.: 10,848

[22] Filed: Jan. 29, 1993

[30] Foreign Application Priority Data

Jan. 30, 1992 [JP] Japan ..... 4-040143
Jan. 14, 1993 [JP] Japan ..... 5-005020

[51] Int. Cl.[6] ..... G03G 15/02
[52] U.S. Cl. ..... 355/219; 361/221
[58] Field of Search ..... 355/219; 361/225, 221, 361/222, 223

[56] References Cited

U.S. PATENT DOCUMENTS

| | | | |
|---|---|---|---|
| 4,259,003 | 3/1981 | Mangal et al. | 355/219 X |
| 4,408,871 | 10/1983 | Kojima | 355/219 X |
| 4,727,453 | 2/1988 | Ewing | 361/225 |
| 4,821,071 | 4/1989 | Oka et al. | 355/219 |
| 5,060,017 | 10/1991 | Ueda | 355/219 X |
| 5,144,368 | 9/1992 | Ohzeki et al. | 355/219 |
| 5,146,281 | 9/1992 | Kisu | 355/219 |
| 5,164,779 | 11/1992 | Araya et al. | 355/219 |

FOREIGN PATENT DOCUMENTS

| | | |
|---|---|---|
| 63-149668 | 6/1980 | Japan . |
| 63-167380 | 7/1988 | Japan . |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

A charging device includes a member to be charged; a charging member, provided connectable to the member to be charged, for charging the member to be a power source for supplying the oscillating voltage to the charging member; a constant voltage element connected electrically in parallel with the portion for generating the oscillating voltage.

13 Claims, 11 Drawing Sheets

FIG. 3A
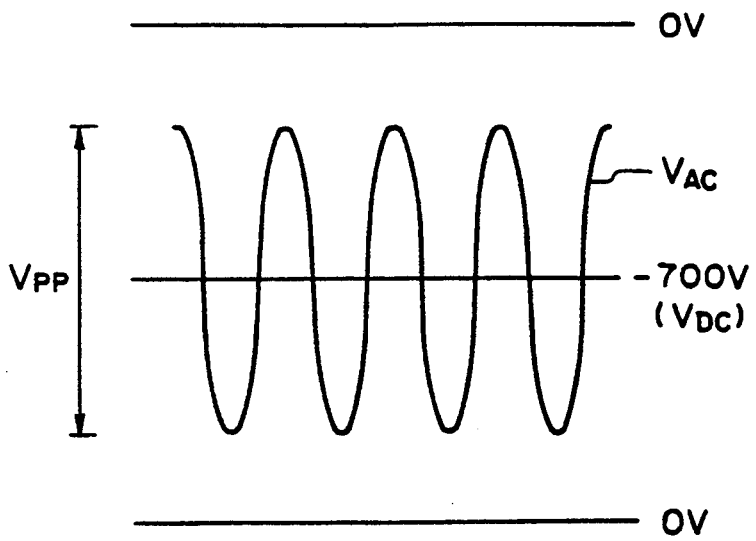
FIG. 3B
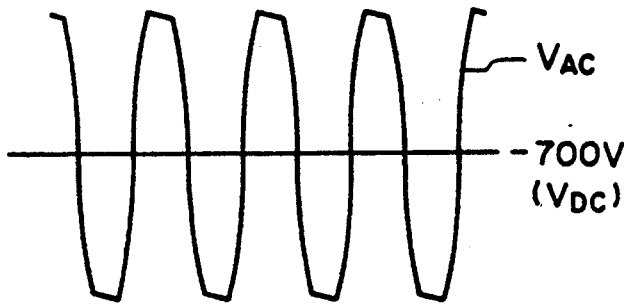
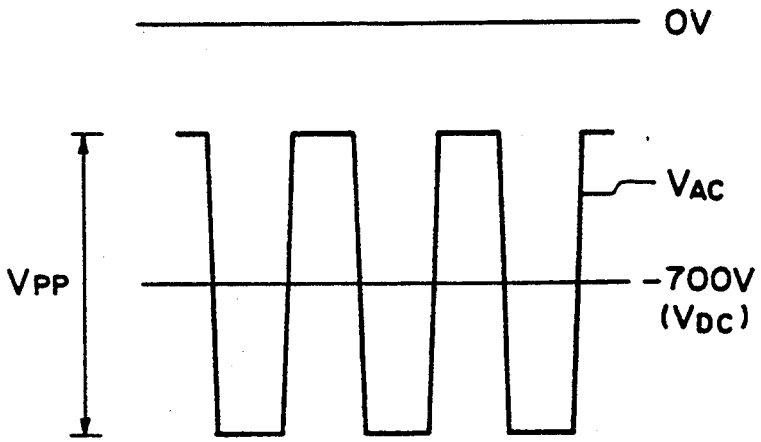
FIG. 4

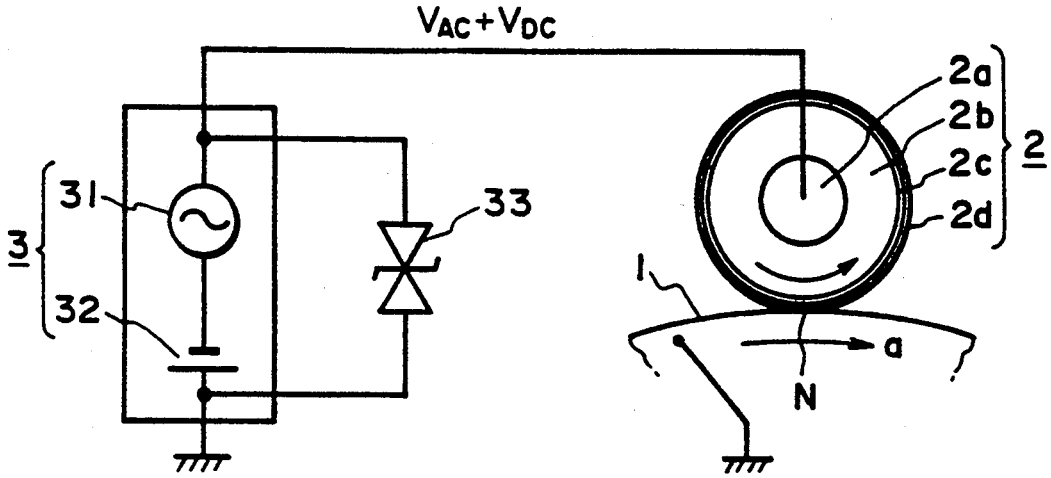
FIG. 5
FIG. 6A
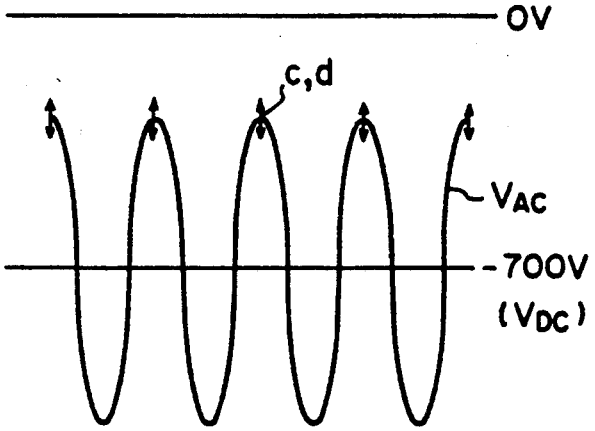
FIG. 6B
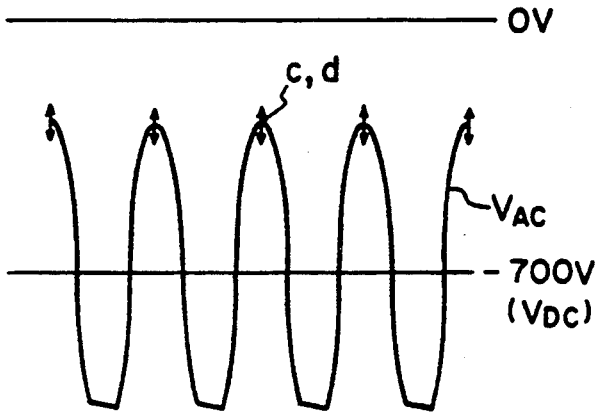

CHARGING DEVICE, IMAGE FORMING APPARATUS AND DETACHABLY MOUNTABLE PROCESS CARTRIDGE HAVING A CONSTANT VOLTAGE POWER SOURCE FEATURE

FIELD OF THE INVENTION AND RELATED ART

The present invention relates to a contact type charging device, wherein a charging member (conductive member) is press-contacted to a member to be charged, and a charging process (a discharging process is included) is performed sequentially to a surface of the member to be charged by applying an oscillating voltage to the charging member by a bias power source. It also relates to an image forming apparatus using the charging device for the charging device for an image bearing member, and to a process cartridge detachably mountable thereto.

For example, in image forming apparatuses, such as an electronic photographic apparatus and an electrostatic recording machine, as for the charging device for electrically charging the surface of the image bearing member functioning as the member to be charged here, such as the electrophotographic photosensitive member and the dielectric member for electrostatic recording, the corona discharging device provided with the wire electrode and the shield electrode has been used, conventionally.

Recently, the charging devices of a contact (direct) type (for example Japanese Laid-open Patent application No. official report of No. 63-167380 etc.) are used, wherein the voltage is applied to the charging member of the roller type (charging roller) and the blade type (charging blade) or the like, and it is contacted to the surface of the member to be charged, and it charges the surface of the member to be charged to the predetermined polarity and potential. As compared with the corona discharging device, the contact charging device has the advantage that the voltage reduction of the power source can be accomplished, and that the amount of corona discharge productions such as ozone is very small, and the like.

Although the application voltage (electric field) for the charging member may contain only the DC voltage, the oscillating voltage (voltage from which the voltage value changes periodically with elapse of time) such as the superimposed voltage of AC voltage and DC voltage is preferable from the standpoint that the charging is uniform (Japanese Laid-open Patent application No. official report of No. 63-149668 etc.).

In order to form a toner image on the photosensitive member drum, the waveform of applied oscillating voltage VAC+VDC for the charging roller functioning as the charging charging member for charging the photosensitive member drum, is as shown in FIG. 11A, for example. Here, if neighborhood of the peak A of the AC component is enlarged, it has been found that it is varying up and down in the range of several 10 v as shown in FIG. 11B, by the investigations by the inventors of this application (c and d). Here, the DC voltage is of the negative polarity.

This is because the load formed by charging roller functioning as the charging member and the photosensitive member drum functioning as the member to be charged, varies in accordance with the contact rotation of the both.

The cause of the load variation is considered as follows. Depending on the area of nip N formed by the press-contact of charging roller to the drum, the resistance and the electrostatic capacity in the contact portion of the both are determined. In a contact following rotation process of the charging roller in accordance with the rotation of the drum, the area of the nip N portion varies. As a result, the above-described load variation has occurred.

The variation of the area of the nip is based on the eccentricity of the shafts of the charging roller and drum, and the deformation of the charging roller surface. Moreover, as the cause of the load variation, there is variation of resistance or the electrostatic capacity in the circumferential direction of the charging roller.

By this load variation, the potential of the drum changes in interrelation with the neighborhood of the peak of FIG. 11(*b*), too.

In the case of reversal development, the toner is charged in the negative polarity in development apparatus. However, a small amount of the reversely charged toner charged to the positive polarity is also produced. More particularly, if the toner particle size is small as in the fine particle toner, this tendency is remarkable. A quantity of the reversely charged toner charged to the positive polarity tends to increase. In such a case, the problem of the so-called "fog" that the toner adheres to the white portion other than the character portion of the transfer material, arises.

In the case of reversal development, by the variation of the voltage depending on the load variation of the above charging members, in the charging portion (nip portion N of the charging roller 2 and the drum 1), if the potential non-uniformity in the form of stripes of the high-low potential is formed on the surface of the drum 1, the positive polarity toner or the reversely charged toner develops it. In the image, a problem that the periodic stripes corresponding to the peaks of the voltage appears in the white portion, arises. In the case that the fog has adhered to the white portion uniformly, it is not so conspicuous. However, if the periodic stripes occurs, the image quality is damaged remarkably.

The above problems are not limited in the case of the charging member being the charging roller. It is the same even when it is in the form of the charging blade or the charging rod.

SUMMARY OF THE INVENTION

The object of the present invention is to provide a charging device, an image forming apparatus and a process cartridge in which the variation of the application voltage to the charging member by the load variation, is prevented.

Another object of the present invention is to provide a charging device, an image forming apparatus and a process cartridge in which the generating of the charging potential non-uniformity of the stripes to the surface of the member to be charged, is prevented.

Another object of the present invention is to provide an image forming apparatus and a process cartridge in which the degradation of image quality by the generating of the stripes in a white ground, is prevented.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 3A shows output waveform of smooth oscillating voltage without the variation by the constant voltage element.

FIG. 3B is a view of the oscillating voltage wave form brought close to the rectangular pulse wave form by cutting the crest of the oscillating voltage depending on the constant voltage element.

FIG. 4 is the view of the waveform of the rectangular pulse wave form voltage without the variation by cutting the portion of the crest and trough of the oscillating voltage with the constant voltage element in the second embodiment of the charging device.

FIG. 5 is an illustration of a major part of a charging device according to a third embodiment.

FIG. 6A is a view of the waveform of the oscillating voltage which removed the variation.

FIG. 6B is a view of the waveform, when the voltage variation is prevented by bringing close to the rectangular pulse wave form by cutting the crest at the negative side of the oscillating voltage.

DESCRIPTION OF THE PREFERRED EMBODIMENTS

The embodiments of the present invention will be described referring to the accompanying drawings.

Figure 10:
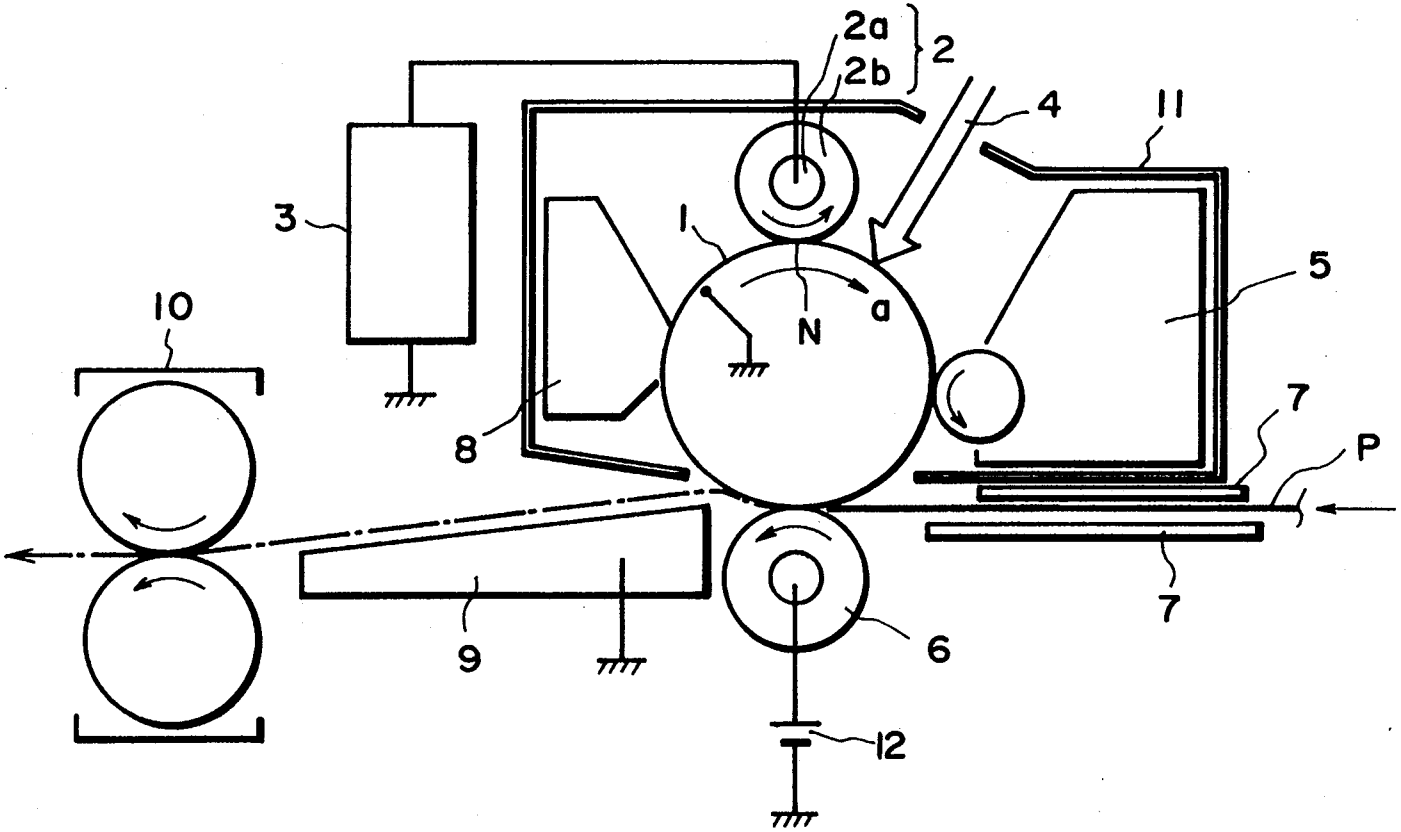
FIG. 10 is a sectional view of the example of the image forming apparatus using the charging device of a contact type as charging means for the image bearing member.

In FIG. 10, as an example of use of a charging means for an image bearing member, a general construction of an example of the image forming apparatus using a charging device of a contact type, is shown. The image forming apparatus of the example is a printer or a copying machine of image transfer type using electrophotographic process.

Designated by reference numeral 1 is the photosensitive drum (drum) functioning as the image bearing member, and a photosensitive member layer is provided on the outer peripheral surface of the conductive drum base member of grounded metal. It is rotated at the predetermined peripheral speed (process speed) in the clockwise direction indicated by an arrow a. The photosensitive member layer of this embodiment is the organic photoconductive layer chargeable to the negative polarity.

Designated by reference numeral 2 is the charging roller functioning as the charging member. For example, it is an electrically conductive rubber roller provided with an electrically conductive elastic layer **2*b* outside a core metal 2*a* which is metal such as the aluminum, while being supported by bearings at the opposite ends of core metal 2*a*, it is arranged substantially in parallel with the drum 1, and it is press-contacted to a drum surface. In the case of this example, the charging roller 2 is driven in accordance with the rotation drive of the drum 1**.

Designated by reference numeral 3 is the bias application power source for the charging roller 2, and from the power source, the oscillating voltage which is the superimposed voltage of the DC voltage and the alternating current voltage is applied to it, and the oscillating electric field is formed between the roller 2 and the drum 1. The peripheral surface of the rotation drum 1 is electrically charged by the contact charging uniformly to the predetermined polarity and potential. In this embodiment, the DC voltage is of the negative polarity. And, photosensitive drum 1 is charged to the negative predetermined potential.

Subsequently, the exposure 4 (the laser beam scanning exposure, projection slit exposure of the manuscript image, etc.) of the object image is made by an unshown exposure means on the the charged surface of the rotating drum 1, by which the electrostatic latent image of the object image information is formed on the rotating drum surface.

The formed latent image is reverse-developed by the toner charged to the negative polarity by the developing apparatus 5. In the position of the transfer roller 6, the toner image is transferred with respect to the surface of transfer material P fed at a predetermined timing to the nip (transfer portion) between the drum 1 and a transfer rollers 6 through a guide 7 from an unshown feed mechanism. A voltage having the polarity opposite from that of the toner charging polarity is applied to the transfer roller 6 by the power source 12. The transfer roller 6 has an electroconductive elastic layer on the core metal.

The transfer material P having passed through the transfer station is separated from the drum surface. And, it is sent to an image fixing device 10 by a conveyance guide 9. And, it is discharged as the image print (the print, copy) after the toner image thereon is fixed by heat and pressure.

The deposited contamination in the form of the non-transferred toner or the paper dust or the like is removed by a cleaner 8 from a drum surface after the image transfer onto the transfer material P. It is thus cleaned, and it is used for image formation repeatedly. And the image formation is presented repeatedly.

The image forming apparatus of the example is the cartridge-type image forming apparatus, wherein the process cartridge 11 contains four process means of drum 1, charging roller 2, development apparatus 5, and cleaner 8 as a unit. And, it is detachably mountable as a unit relative to the main assembly of the image forming apparatus. This process cartridge 11 may have at least the drum 1 and the charging roller 2.

Figure 1:
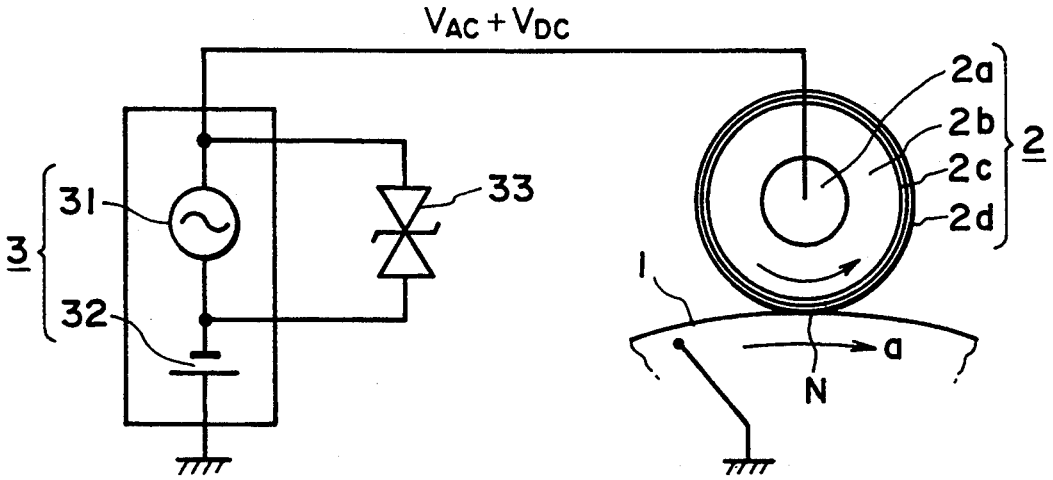
FIG. 1 is an illustration of a major part of a charging device according to a first embodiment.

FIG. 1 is an illustration of a major part of the charging device according to a first embodiment usable with the image forming apparatus of FIG. 10. As described hereinbefore, the photosensitive member drum 1 has an organic photoconductive layer chargeable to the negative polarity.

Designated by reference numeral 2 is a charging roller functioning as the charging member. The charging roller 2 used in this embodiment is provided with a conductive rubber layer 2*b* of $10^4$–$10^5$ ohm.cm of, such as EPDM (ethylene-propylene-diene terpolymer), on a conductivity core metal 2*a*, coaxially therewith. On the outer peripheral surface, in order to prevent the leakage, intermediate resistance layer 2*c* comprising hydrin rubber or the like having a larger volume resistivity ($10^7$–$10^9$) than rubber layer 2*b* is provided. Furthermore, in order to avoid that the plasticizer of intermediate resistance layer 2C adheres to the drum 1, the blocking layer of $10^7$–$10^{10}$ ohm.cm comprising the Nylon materials is provided as a surface layer 2*d* on the outer peripheral surface. The hardness is about 50–70 in the Asker C scale.

This charging roller 2 is arranged substantially in parallel with the drum 1. And, the opposite ends of core metal 2*a* are supported by bearings, and, it is abutted to a drum surface by 1400 g of the total pressures, and is rotated by the rotation of the drum 1.

The bias application power source 3 comprising the alternating current power source 31 (oscillating component generating means) and the DC power source 32 connected in series with each other, supplies to the core metal 2*a* of the charging roller 2 a predetermined oscillating voltage (VAC+VDC), by which the peripheral surface of the rotating drum 1 is electrically charged to the predetermined polarity and potential.

Desirably, oscillating voltage applied to the charging member has the peak-to-peak voltage which is 2 or more times the charge starting voltage (the DC voltage when the charging of the member to be charged in the form of the photosensitive member starts, when only DC voltage is applied). This is because there is effect of leveling the potential of the member to be charged.

The oscillating voltage is the voltage periodically changing with time. The waveform is not limited to the sine wave, and the rectangular pulse wave form, a triangle wave, and the pulse wave are suitable. The alternating current voltage includes the voltage of the rectangular pulse waveform formed by rendering on and off the DC power source periodically. Moreover, when only the alternating current voltage is applied to the charging member, the member can be electrically discharged.

In this embodiment, it is desirable that AC current supplied from the AC power source is controlled at a constant current, in order that the resistance variation of the charging roller by the environmental variations, such as temperature and humidity, does not affect the potential uniforming effect, In this embodiment, as shown in FIG. 1, the varistor 33 of the suitable size functioning as the constant voltage element is disposed in parallel to the AC power source 31 of the bias application power source 3.

By the provision of this varistor 33, the variation of the application voltage by the load variation resulting from the contact rotation with the drum 1 and the charging roller 2, can be prevented.

Figure 2:
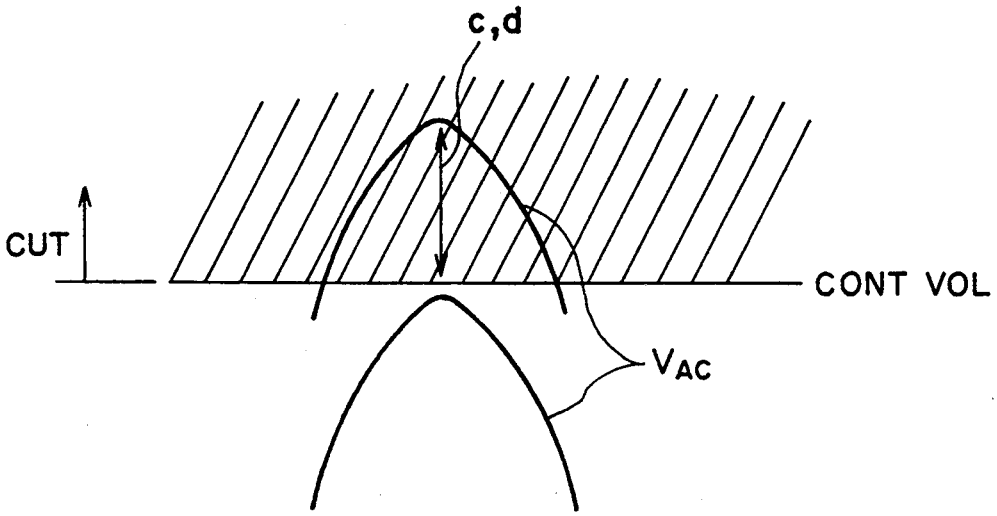
FIG. 2 is a diagram, in which the wave form of the oscillating voltage without the variation is provided by cutting the changing portion of the oscillating voltage by the constant voltage element.

The reason is as follows. The variation in the peak of the oscillating voltage by the the load variation is removed by cutting the changing portion (hatched portion in FIG. 2) of the oscillating voltage by the constant voltage element 33 such as the varistor. Thus, the waveform of the oscillating voltage without the variation is provided. Therefore, the over-charged portion by the variation of the oscillating voltage is cut. Therefore, the charging roller 2 can charge the drum 1 uniformly. Actually, the applied oscillating voltage for the charging roller 2 was as follows:

Alternating current voltage VAC;

Frequency of 550 Hz; and

VPP value=1950 v (without the varistor)

DC voltage VDC; −700 v was superimposed (VAC+VDC). When the varistor 33 having 860 v (rated 1 mA current), is used, as shown in FIG. 3A, a variation free and substantial sine wave can be outputted, and the periodic stripes by the fog of the white portion could be removed.

In the above example, the varistor having a size exactly suitable for avoiding the variation of Sine wave, was used. But when the varistor 33 has 750 v (rating), the situation is as shown in FIG. 3B. In this way, the variation of the voltage can be avoided also by bringing close to the rectangular pulse waveform by cutting the crest of the sine wave by using the somewhat slightly small varistor, and the periodic stripes by the fog of the white portion could be removed.

If the value not more than the half of the peak-to-peak voltage of the oscillating voltage without use of the varistor is selected for the rated voltage of the varistor, the changing portion of the oscillating voltage can be cut with certainty. Therefore, it is desirable.

However, the variation of the voltage can hardly be avoided using the varistor larger than the size of ½ VPP value of the oscillating voltage (in the conditions of the above, for example, varistor of 1000 v (rating)).

Furthermore, in the case of using the varistor having too small rated voltage, VPP value is too small, and, the roughened charging unevenness occurs. Therefore, desirably, the size of the varistor 33 is determined suitably in accordance with the size of VPP value of the alternating current voltage. It is desirable that the peak-to-peak voltage of the oscillating voltage is 2 or more times of the charge starting voltage of a photosensitive drum. Therefore, it is desirable that the rated voltage of the varistor is more than the charge starting voltage. According to this embodiment, the charge starting voltage was −560 v. As for the rated voltage of the varistor, it is more desirable that it is 750 v or more.

As described hereinbefore, in the case of the constant current control of AC current supplied to the charging member, the peak-to-peak voltage supplied to the charging roller changes depending on the resistance variation of the charging roller by the environmental variation. The rated voltage of the varistor may be not more than a half of the peak-to-peak voltage of the oscillating voltage without the varistor only at the time of the low temperature and low humidity condition, for example of 15 degrees C., 10%.

This is because the stripe pattern is easy to come out by the fog, particularly during the low temperature and low humidity condition under which the peak-to-peak voltage is large. For example in the case that the peak-to-peak voltage varies in the range of 1700 v–1900 v, the rated voltage of the varistor may be set as 910 v.

As shown in this embodiment, if the varistor 33 is connected in parallel with the alternating current power source 21, the variation of the alternating current voltage can be prevented independently from the DC bias level, also in the image forming apparatus provided with the mechanism for varying the DC voltage VDC varying and regulating the density and the line width, the variation of the alternating current voltage can be prevented independently from the DC bias level. Therefore, it is preferable.

The alternating current power source can be constant-voltage-controlled so that the constant alternating current voltage may be supplied to charging roller.

VPP value of alternating current voltage VAC is increased from the set value beforehand, and the portions of the crest and trough of the sine wave are cut by the varistor 33. By doing so, the rectangular pulse waveform is provided, and the VPP value regulated, so that the variation of the alternating current voltage is prevented, and also a larger current flows by selecting the rectangular pulse wave form. Therefore, the charging performance of the charging roller 2 can be improved. Actually, when the applied oscillating voltage for the charging roller 2 is as follows:

Alternating current voltage VAC;

Frequency of 550 Hz, and

VPP value=2200 v (without the varistor)

DC voltage VDC; −700 v, which are superimposed to a voltage VAC+VDC.

When the varistor 33 has 860 v (rating), as shown in FIG. 4, the smooth rectangular pulse waveform without the variation having VPP value of a size almost equal to the above-described FIG. 3A, can be outputted, and the periodic stripes by the fog of the white portion is removed, and charging capability to charge uniformly improves as compared with the case of FIG. 3A. Therefore, the transfer memory of the drum 1 by the overcurrent flowing to the drum 1 through transfer material P by the resistance unevenness in the circumferential direction of the transfer roller 6 (FIG. 10), and the photosensitive member drum 1 and the local resistance unevenness in the nip of the transfer roller 6, can be avoided.

The problem that the fine spots (sands) occurs after one rotation of the drum by the drum memory of transfer back can also be solved.

In the case that the fog by the reversely charged toner of the above-mentioned is particularly remarkable, the method of connecting the oscillating voltage generating means and the varistor which will be described is effective.

In the case that reversal development is carried out with the image forming apparatus construction of the above-described FIG. 10, although the regularly charged toner is charged in the negative polarity some is charged to the positive polarity (reversely charged toner). Particularly, if the toner particle size is small, the amount of the reversely charged toner tends to increase. In the case of this reversal fog what is necessary is just to avoid the variation of the waveform at the negative side of the AC power source 31. Therefore, as shown in FIG. 5, the varistor 33 is disposed in parallel with the alternating current power source 31 and the DC power source 32 connected in series. By doing so, the periodic stripes by the reversal fog in the white portion by the load variation of the charging roller 2 can be prevented.

Actually, when the applied oscillating voltage for the charging roller 2 is as follows:

Alternating current voltage. VAC;

Frequency of 550 Hz, and

VPP value=1950 v (with no varistor).

DC voltage VDC; −700 v, are superposed, where

Max. Voltage $V_{max}=\frac{1}{2}VPP+|VDC|=1675$ v. When the varistor 33 has 1560 v (rating), as shown in FIG. 6A, substantial sine wave without variation c and d in the peak at the negative side of the AC voltage can be generated (the peak of the positive side of the AC voltage is making variation c and d). This way, the periodic stripes by the reversal fog of the white portion could be removed. In this way in the case of connecting the varistor 33 electrically in parallel with the DC power source and the AC power source, For the purpose of the prevention of the variation of one side of the peak voltage, it is desirable that the rated voltage of the varistor 33 is not more than the maximum voltage value by the DC and the alternating current power source.

In the above, the varistor has a exactly suitable size to avoid variation c and d of the sine wave. But, if the the varistor 33 has 1450 v (rating), the results are as shown in FIG. 6B. Also by bringing close to the rectangular pulse waveform by cutting the mountain by the side of defeat of the sine wave by using the varistor somewhat slightly smaller than the above-described ones, .the variation of the voltage can be prevented, and, the periodic stripes by the reversal fog of the white portion can be removed.

Also in this case, similarly to the embodiment already described, the size of the varistor 33 is determined suitably in accordance with the size and the size of DC voltage VDC of VPP value of alternating current voltage VAC. Namely, in order to prevent the roughened potential non-uniformity, it is desirable that the peak-to-peak voltage which actually is fed to the charging roller has the 2 or more-time charge starting voltage of a photosensitive drum, and, {varistor rated voltage—application DC voltage+$\frac{1}{2}$VPP} (VPP is the peak-to-peak voltage of the output voltage of the alternating current voltage without the varistor) is 2 or more times of the charge starting voltage of a photosensitive drum.

Figure 7:
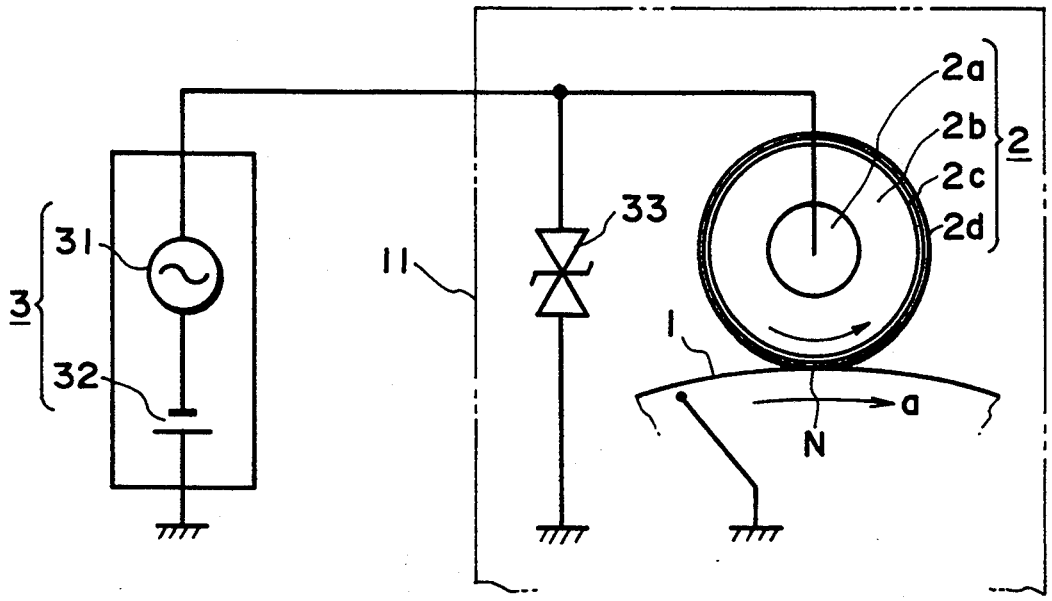
FIG. 7 is a schematic view of apparatus which disposes the constant voltage element at the side of the process cartridge.

In the case of this embodiment, since the constant voltage element 33 is connected in parallel with the load, the constant voltage element 33 does not necessarily need to be disposed in bias power source 3 side. In the image forming apparatus of the detachable cartridge type as shown in the above-described FIG. 10, the constant voltage element 33 may be attached at the side of cartridge 11, as shown in FIG. 7, the constant voltage element 33 may be attached at the side of cartridge 11. Therefore, the latitude of a design can be improved.

In this embodiment, the varistor 33 was used as constant voltage element. But, a Zener diode may be used instead thereof. A simple limiter circuit may also be used.

Figure 8:
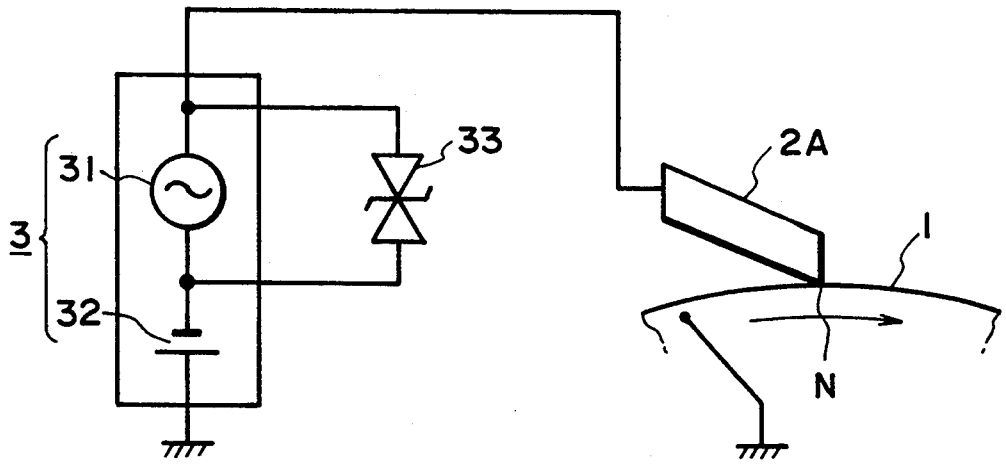
FIG. 8 is a schematic view of the charging device according to a fourth embodiment using the charging blade as the charging member.

Also in the charging blade which is one of the contact charging member, as shown in FIG. 8, by the photosensitive member drum 1 and charging blade 2A making relative movement while in contact with each other, the alternating current voltage varies by the load variations, such as the vibration by the change of the chatter of charging blade 2A, or the contact pressure, and the rotation of the photosensitive member drum 1. As shown in FIG. 8, by disposing it in parallel with the AC power source 31, or by disposing the varistor 33 in parallel with the power source 3, the variation of this alternating current voltage is removed. By doing so, the stable oscillating voltage can be applied to charging blade 2A. The photosensitive member drum can be charged uniformly.

In the case of charging blade 2A the variation of the application voltage caused by the load variation by the plastic deformation, such as the permanent set in fatigue of the blade, can be also controlled by the varistor, so that the photosensitive member drum 1 can always be charged uniformly.

By adding the varistor 33, the variation of the application voltage by the load variation by the scraping by the sliding movement of between charging blade 2A and the photosensitive member drums 1 in the long term use is controllable, too.

Figure 9A:
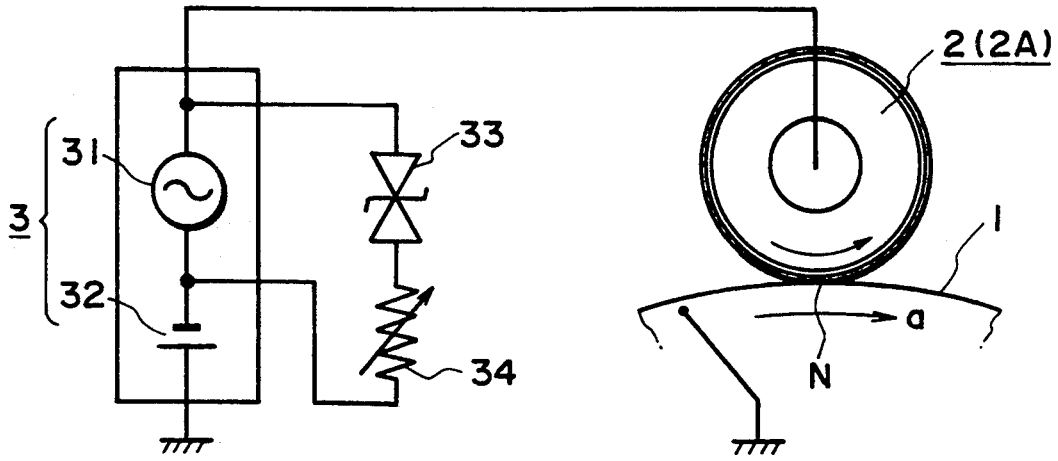
FIGS. 9A and B are the illustrations of a major part of the charging device according to a fifth embodiment having a variable resistor in series with a constant voltage element.
Figure 9B:
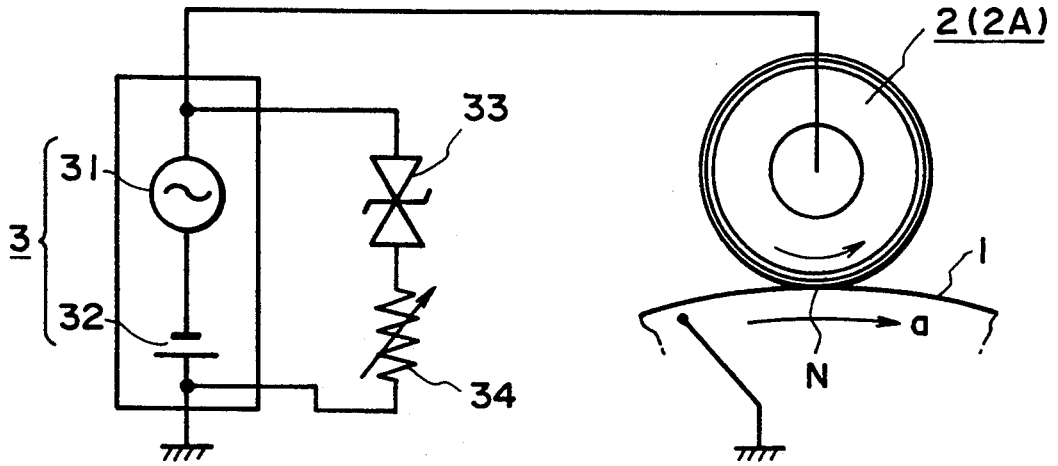

In the embodiment stated above, as shown in FIGS. 9A and 9B, by disposing the variable resistor 34 in series with the varistor 33, the control voltage of the varistor 33 may be adjusted, by which VPP value of the alternating current voltage is adjusted. VPP value of the alternating current voltage is adjusted.

By disposing the variable resistor 34 in series to the constant voltage element 33, the variation of the performance of the constant voltage element 33 can be removed by the variable resistor 34. VPP value of the constant AC voltage can be assured. Moreover, also with respect to the variation of the size of VPP value of the alternating current voltage, the AC voltage without the variation can be assured by adjusting the control voltage of the constant voltage element 33 by the variable resistor 34.

Figure 12:
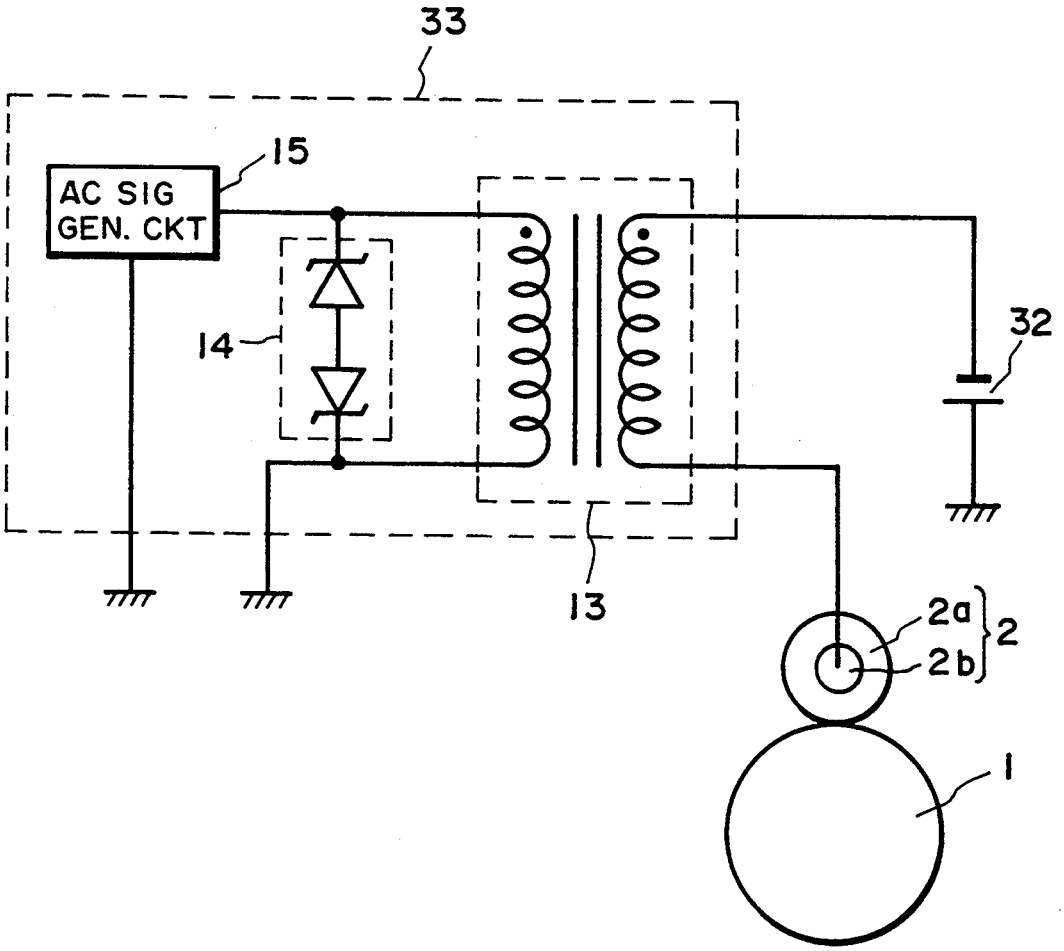
FIGS. 12–15 are schematic views of sixth, seventh, eighth, and ninth embodiments of the charging device.

FIG. 12 shows another example in which the constant voltage element is connected with an oscillating voltage generating means.

To the core metal *2b* of charging roller 2 the DC power source 3 which applies the voltage to charging roller 2 in order for photosensitive drum 1 be charged uniformly 2 and the alternating current power source 33 are connected, as shown in FIG. 12, they are connected through the transformer 13.

By disposing the constant voltage element 14 of a suitable size in parallel to the primary coil of this transformer 13, the variation of the application voltage by the load variation (it is attributable to the charging roller 2 and the photosensitive drum 1 making contact rotation) to be generated at the side of the secondary coil can be prevented.

To the primary coil of the transformer 13, the alternating current voltage be supplied by alternating current signal generating circuit 15.

It is considered that with the primary coil side of the transformer 13 by the constant voltage element 14, the variation in the peak of the AC voltage by the the load variation is removed as follows. By cutting the changing portion of the AC voltage of a primary coil side, the changing portion of the alternating current voltage of a secondary coil side is cut. Therefore, the waveform of the AC voltage without the variation is made. Therefore, it is possible to cut the over-charged portion by the variation of the alternating current voltage to be applied to charging roller 2, and charging roller 2 can charge photosensitive drum 1 uniformly.

Actually, the description will be made as to the case in which VPP=20 v is applied to the primary coil, and the secondary coil generates VPP=2000 v, in the transformer 13 which generates VPP1=3 kV to the secondary coil upon VPP=30 v supplying to the primary coil. The following has been generated by the side of the secondary coil.

DC Voltage (VDC): −700 v,

AC Voltage (VAC): Frequency 500 Hz and VPP=2000 v as shown in FIG. 12.

If at this time two Zener diode pairs (10 v (at rating, the time of 1 mA current)) namely 20 v are connected in parallel with the primary coil of the transformer 13, then by cutting the changing portion of the alternating current bias, as shown in FIG. 3(*a*), a smooth sine wave without the variation can be generated by the secondary coil. The periodic stripes by the fog of the white portion could be removed.

The above-described embodiment used a Zener diode of an exactly suitable size which cuts only the vibrating portion in order to avoid the variation of the sine wave. If use is made of two Zener diode pairs (8 v (rating)), i.e., 16 v. as shown in FIG. 3(*b*), the variation of the voltage is avoided also by bringing close to the rectangular pulse waveform by cutting the crest of the sine wave by using a somewhat slightly small Zener diode pair, and the periodic stripes by the fog of the white portion could be removed.

However, avoiding the variation of the voltage is hardly made even if the use is made with a Zener diode pair larger than VPP which is fed to the primary coil (for example, 2 Zener diode pairs of 11 v (rating) in the conditions of the above example). Furthermore, in the case using the Zener diode of the control voltage which is too small, since VPP is as described hereinbefore too small, and the roughened charging non-uniformity occurs, it is preferable that the size of the Zener diode is determined suitably in accordance with the size of VPP of the alternating current voltage which is fed to the primary coil. In addition the minimum of VPP is as described in the foregoing embodiment.

As in this embodiment, if it is connected in parallel with the primary coil of the transformer 13, the variation of the AC voltage can be avoided independently from the DC bias level also in the image forming apparatus provided with the mechanism for making DC voltage VDC varying and regulating the density and the line width.

Even when the constant voltage element 14 is connected in parallel with the secondary coil, the same effect is provided. However, in this case, VPP=2000 v results, and accuracy of the constant voltage element which controls large VPP decreases, and the cost is high. Therefore, it is much preferred to control by small VPP portion as in the primary coil. This is because an accurate control is possible. The cost can be reduced.

VPP of the alternating current voltage to be fed to the primary coil is increased from the set value beforehand, and the portion of the crest and trough of the sine wave is cut by a Zener diode pair. By doing so the rectangular pulse wave form is produced. Thus, VPP is regulated. The variation of the alternating current voltage is prevented. Furthermore, the rectangular pulse waveform is provided. By doing so, more current flows. Therefore, the charging performance of an electric conduction roller can be increased.

Actually, VPP=25 v is supplied to the primary coil, and when the AC voltage (VAC) (frequency 550 Hz Vpp=2000 v) to be applied to a charging roller is required, a Zener diode pair (10 v (rating) 2 pieces, i.e. 20 v,) is disposed in parallel with the primary coil as shown in FIG. 12. Then, in a secondary coil side, as shown in FIG. 4, the smooth rectangular pulse wave form without the variation with VPP of a size equal to FIG. 3(*a*) can be generated. The periodic stripes by the fog of the white portion is removed. Furthermore, since charging capability to be charged uniformly increases as compared with FIG. 3(*a*), the transfer memory of the drum by the overcurrent flowing to the drum through the transfer material by the local resistance unevenness in the nip of between the photosensitive drum and the transfer roller and the circumferential resistance unevenness of a transfer roller, can be avoided. The problem that the fine spots (sands-like) arises after one rotation of the drum by the memory of the drum after the transfer is solvable, too.

Figure 13:
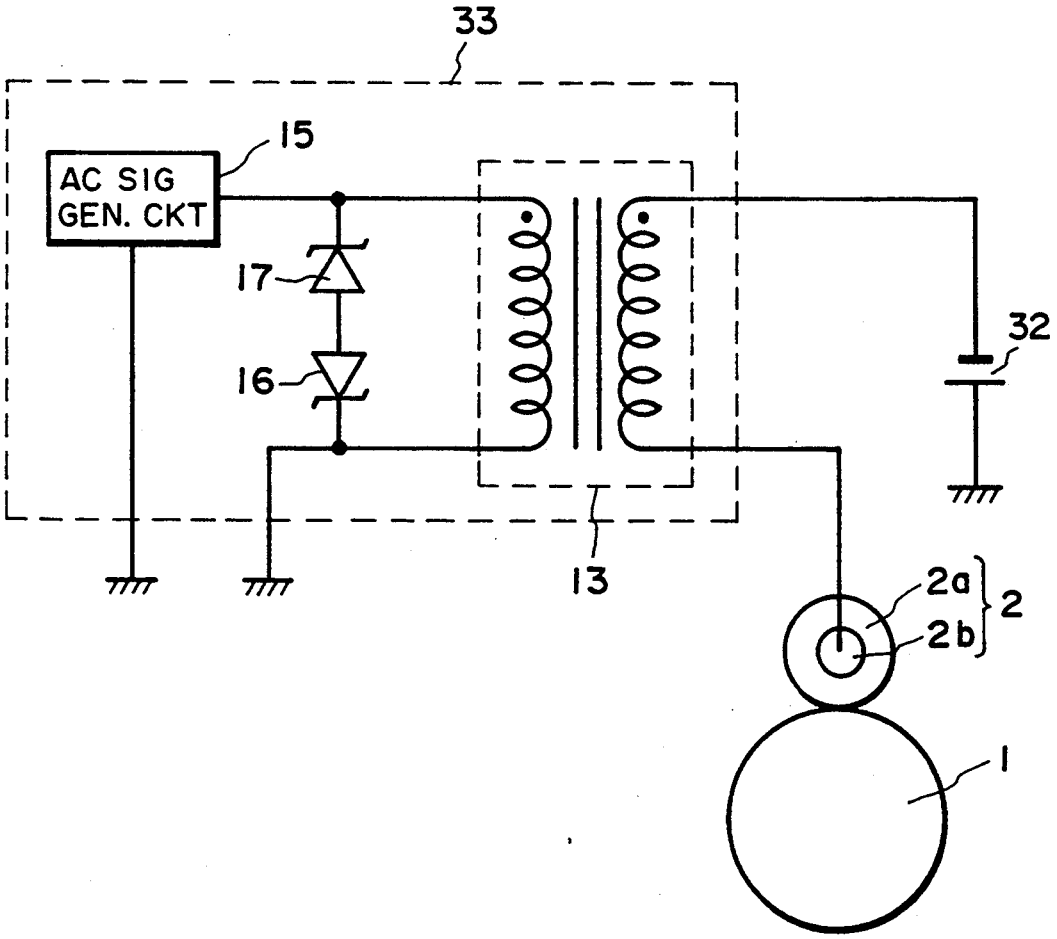

In the case that the fog by the reversely charged toner of the above-mentioned is particularly remarkable, the following method is effective. In the case of reversal development with the apparatus construction as shown in FIG. 10, the regularly charged toner is charged in the negative polarity. However, some is charged to the positive polarity (reversely charged toner). If the toner particle size is small particularly, the amount of the reversely charged toner tends to increase. However, in the case of this reversal fog, since what is necessary is just to avoid the variation of the wave at the negative side of the AC power source, and therefore, as shown in FIG. 13, the Zener diode 16 and diode 17 are combined in parallel with the primary coil so that it cuts the variation at the negative side of the AC component of the primary coil of the transformer 13, so that the periodic stripes by the reversal fog in the white portion by the load variation of a charging roller can be prevented.

Actually, if use is made of the Zener diode 16 (10 v (rating)) and diode 17, the smooth sine wave without the variation can be generated at the side of the secondary coil in the peak at the negative side of the AC voltage as shown in FIG. 6(*a*) (the peak of the positive side of the AC voltage is varying). Thus, the periodic stripes by the reversal fog of the white portion could be removed.

The above-described embodiment used a Zener diode having a size exactly suitable for avoiding the variation of the sine wave. However, if use is made of the Zener diode (8 v (rating)) the result as shown in FIG. 6(*b*). By bringing close to the rectangular pulse wave form by cutting the crest at the negative side of the sine wave by using the somewhat slightly small Zener diode, the variation of the AC voltage could be avoided, and the periodic stripes by the reversal fog of the white portion could be removed.

In this case, too, similarly to the embodiment already shown it is preferable that the size of the Zener diode is determined suitably in accordance with the size of Vpp of the alternating current voltage, or the size of DC voltage VDC.

In this embodiment, although it used the Zener diode 16 as the constant voltage element, the same effect is provided even if the use is made of a simple limiter circuit in place thereof.

Figure 14:
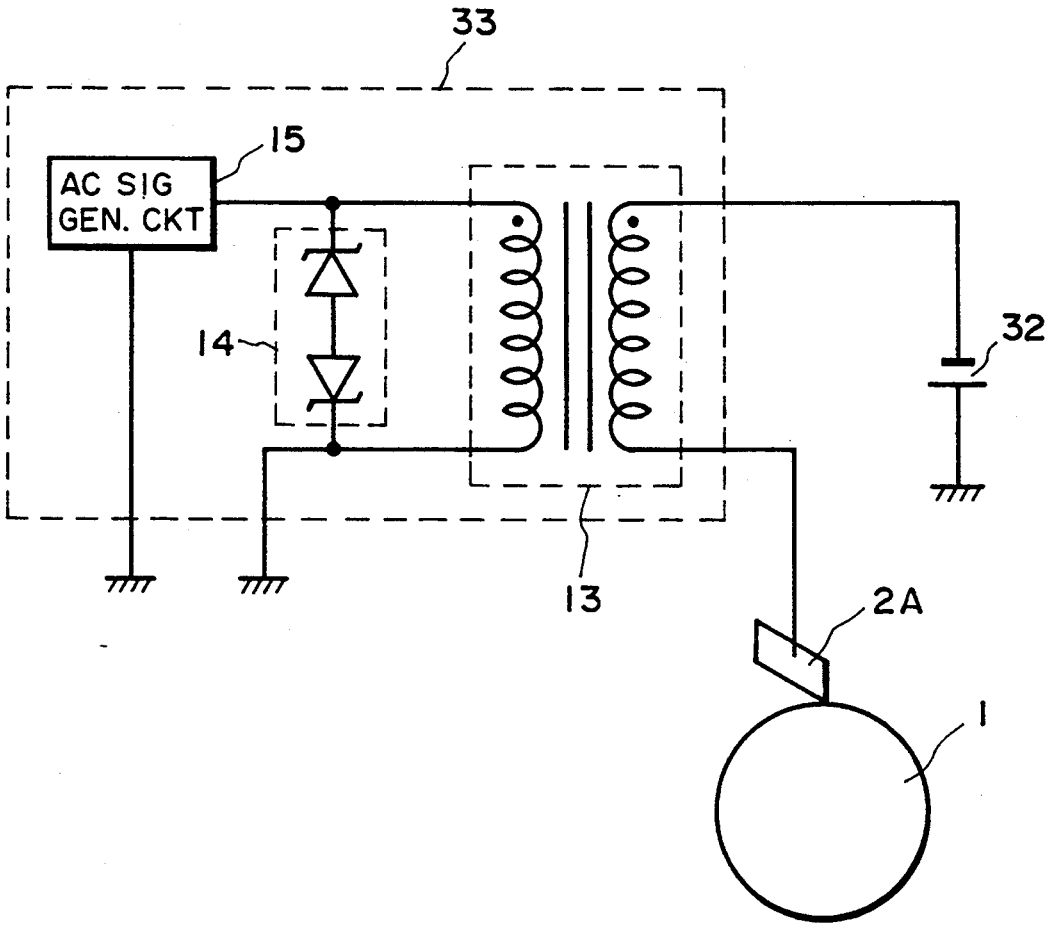

Also in the charging blade which is one of the contact charging, as shown in FIG. 14, by making the contact rotation of photosensitive drum 1 and the charging blade 40 by the load variation such as the chatter of the charging blade 40, the change of the contact pressure, the vibration by the rotation of a photosensitive drum, the alternating current voltage varies. The variation of this alternating current voltage is removed by disposing a Zener diode pair 14 in parallel with the alternating current power source as shown in FIG. 14. By doing so, the stable AC voltage can be applied to the charging blade, and the photosensitive drum 1 can be charged uniformly.

In the case of the charging blade, the variation of the application voltage caused by the load variation by the plastic deformation such as the permanent set in fatigue of the blade can be controlled. A photosensitive drum can always be charged uniformly.

The variation of the application voltage by the load variation by the charging blade and the photosensitive drum having shaven by the sliding movement by durability is controllable by adding the Zener diode pair 14, too.

Figure 15:
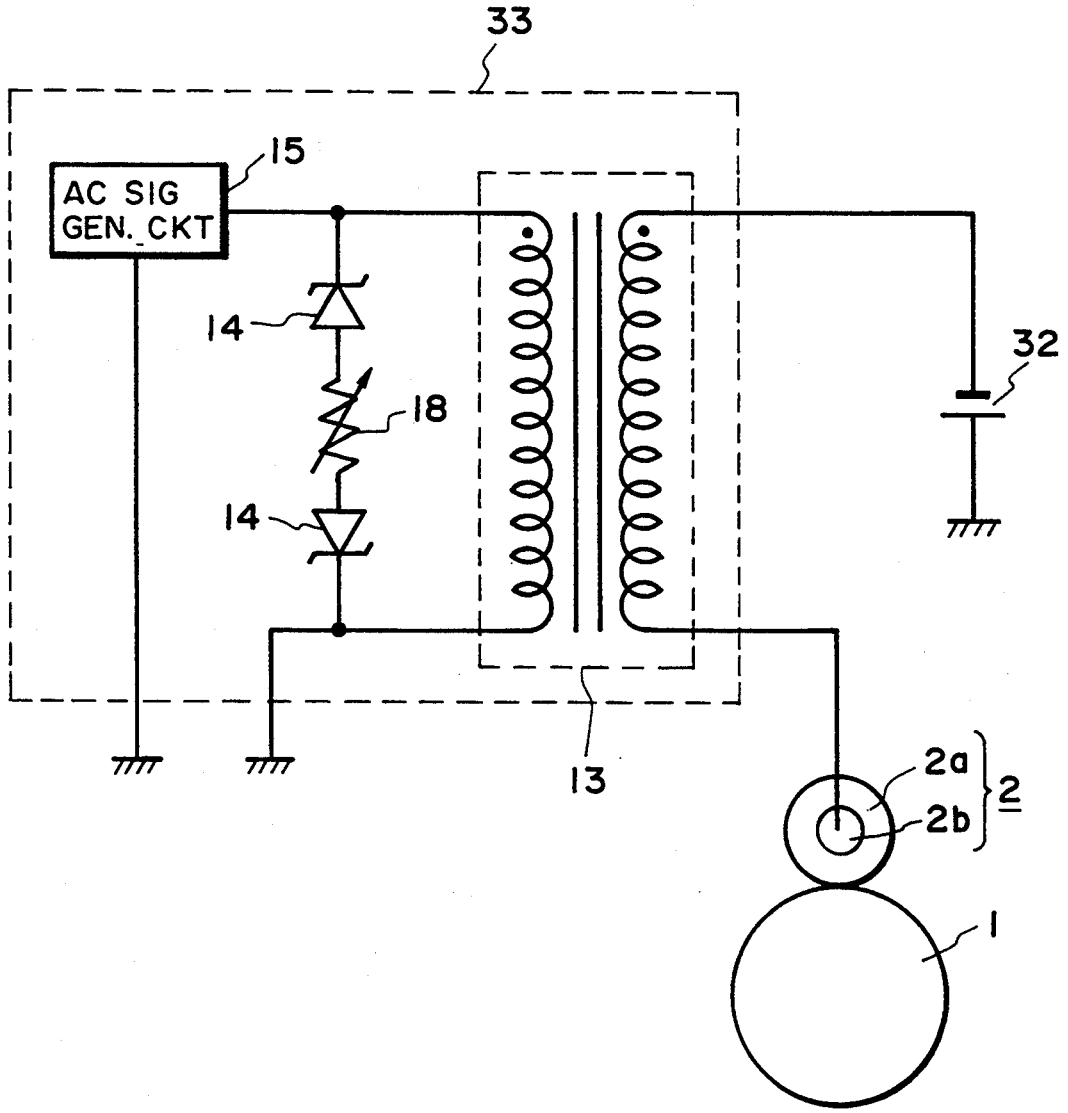

In the embodiment shown in FIG. 12–FIG. 14 stated above, as shown in FIG. 15, the variable resistor 18 is disposed in series with the Zener diode 14 and 16, and the resistance value of the variable resistor 18 is adjusted, so that the limit value of the voltage to be applied to the primary coil can be made variable. VPP value (peak-to-peak value) of the AC voltage can be adjusted.

By disposing the variable resistor in series to the constant voltage element, the variation of the performance of the constant voltage element can be removed by the variable resistor, and constant VPP of the AC voltage can be assured. Also with respect to the variation of the transformer, by adjusting Vpp of the AC voltage by the variable resistor, AC voltage without the variation is easily provided with certainty.

(a) By disposing constant voltage element as described above upon charging the member to be charged sequentially by the charging member, the variation of the application voltage due to the load variation can be prevented.

Namely the waveform of the oscillating voltage without the variation can be provided by cutting the changing portion attributable to load variation in the peak of oscillating voltage by the constant voltage element. Accordingly, the over-charged portion by the variation of the oscillating voltage is cut, and therefore, the member to be charged can be charged uniformly.

(b) VPP value (peak-to-peak value) of the oscillating component is increased from the set value beforehand, and the rectangular pulse waveform is provided by cutting the portion of the crest and trough of the oscillating voltage waveform by the constant voltage element, by which VPP value is regulated. By doing so, the variation of the AC voltage is avoided, and furthermore, since current flows mostly by using the rectangular pulse wave form, it can improve the charging performance.

(c) Charging capability to be charged uniformly is improved, and therefore, in the image forming apparatus, the decline of quality of image attributable to the generating of the stripes in a white ground resulting from the charging potential non-uniformity in the form of stripes on an image bearing member surface, can be avoided.

In the transfer type image forming apparatus, the transfer memory of the image bearing member attributable to the overcurrent flowing to the image bearing member through the transfer material by the circumferential resistance unevenness of the transfer member and the local resistance unevenness in the nip between the image bearing member and the transfer members, can be avoided. The problem that the fine spots (so-called sands) occurs after an image bearing member round by this transfer memory is solvable, too.

In the case of the reversal fog what is necessary is just to prevent the variation of the wave of one side (negative side) of the alternating current power source. Therefore, the constant voltage element is disposed in parallel with the alternating current power source and the DC power source connected with series of the bias application power source, by which the periodic stripes by the reversal fog in the white portion by the load variation of the charging member can be prevented.

(d) The variation of the application voltage caused by the load variation attributable to the plastic deformation such as the permanent set in fatigue of the charging member can be controlled by the constant voltage element, too, so that the member to be charged can always be charged uniformly.

By adding the constant voltage element, it is possible to also control the variation of the application voltage attributable to the load variation attributable to the charging member and the member to be charged being shaven by the sliding movement in the long term use.

(e) By disposing variable resistor in series with constant voltage element, the control voltage of the constant voltage element can be adjusted, and VPP value of the oscillating voltage can be adjusted.

The variation of the performance of the constant voltage element can be removed by the variable resistor by disposing the variable resistor in the constant voltage element in series. And VPP value of the constant AC voltage can be assured. Moreover, the oscillating voltage without the variation is easily securable by adjusting the control voltage of the constant voltage element by the variable resistor also against the variation of the size of VPP value of the oscillating voltage.

Furthermore, it is possible to also suppress the generation of the electrical noise by avoiding the variation of the application voltage.

In the foregoing, the present invention can be applied in the case of regular development, although the reversal development has been described, if the present invention is applied in regular development, the advantageous effect that the solid black image is uniform is provided.

While the invention has been described with reference to the structures disclosed herein, it is not confined to the details set forth and this application is intended to cover such modifications or changes as may come within the purposes of the improvements or the scope of the following claims.

What is claimed is:

1. A charging device comprising:

a member to be charged;

a charging member, provided contactable to said member to be charged, for charging said member to be charged;

a power source for supplying an oscillating voltage between said charging member and said member to be charged;

a constant voltage element connected electrically in parallel with said power source for supplying the oscillating voltage.

2. A process cartridge detachably mountable to an image forming apparatus, comprising:

a member to be charged, said member to be charged capable of bearing an image formed thereon;

a power source for supplying an oscillating voltage between said charging member and said member to be charged;

a charging member, provided contactable to said member to be charged, for charging said member to be charged, wherein an oscillating voltage is applied between said charging member and member to be charged;

a constant voltage element connected electrically in parallel with said power source for supplying the oscillating voltage.

3. A process cartridge according to claim 2, wherein said process cartridge further comprising a developing means for developing a latent image on said image bearing member with toner.

4. An image forming apparatus, comprising:

an image bearing member;

a charging member, provided contactable to said image bearing member, for charging said image bearing member;

a power source for supplying an oscillating voltage between said charging member and said member to be charged;

a constant voltage element connected electrically in parallel with said power source for supplying the oscillating voltage.

5. An apparatus according to claim 4, wherein said power source comprises an AC power source and a DC power source connected in series.

6. An apparatus according to claim 5, wherein said constant voltage element is not connected electrically in parallel with said DC power source while being connected electrically in parallel with said AC power source.

7. An apparatus according to claim 5, wherein said constant voltage element is connected electrically in parallel with said AC power source and said DC power source.

8. An apparatus according to claim 5, wherein said AC power source comprises a transformer including a primary coil and said constant voltage element is constant voltage element is connected electrically in parallel with said primary coil.

9. An apparatus according to claim 6, wherein a rated voltage of said constant voltage element is not more than a half of a peak-to-peak voltage of the oscillating voltage.

10. An apparatus according to claim 9, wherein a rated voltage of said constant voltage element is not more than a charge starting voltage for said image bearing member.

11. An apparatus to claim 7, wherein a rated voltage of said constant voltage element is not more than a maximum voltage value of the oscillating voltage.

12. An apparatus according to claim 11, wherein a rated voltage of a varistor minus a DC voltage of said DC source plus one-half of a peak-to-peak voltage of the oscillating voltage is not less than twice a charge starting voltage for said image bearing member.

13. An apparatus according to claim 8, wherein a rated voltage of said constant voltage element is not more than one-half of a peak-to-peak voltage fed to said primary coil.

* * * * *

UNITED STATES PATENT AND TRADEMARK OFFICE

CERTIFICATE OF CORRECTION

PATENT NO. : 5,412,455

DATED : May 2, 1995

INVENTOR(S) : Kazuaki ONO, et al.

It is certified that error appears in the above-indentified patent and that said Letters Patent is hereby corrected as shown below:

Title Page:

[56] REFERENCES CITED

"63-149668 6/1980" should read --63-149668 6/1988--.

[57] ABSTRACT

Line 2, "connectable" should read --contactable--.
Line 3, "be a" should read --be charged; a--.

COLUMN 1:

Line 56, "charging charging" should read --charging--.
Line 64, "by" should read --by the--.

Figure 11A:
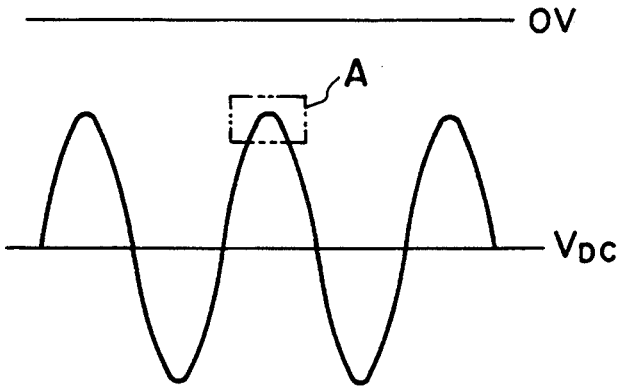
FIG. 11A is a view of the wave form of the applied oscillating voltage for the charging roller functioning as the charging member.
Figure 11B:
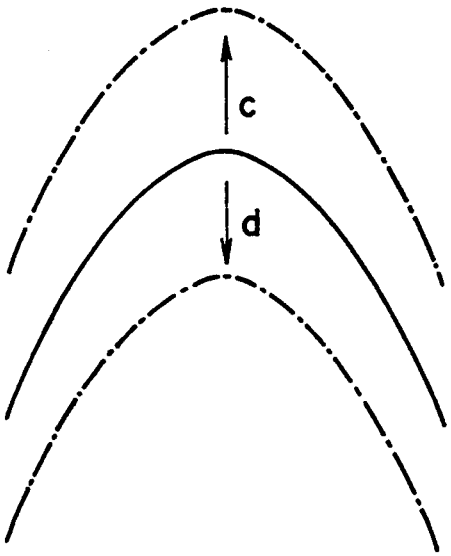
FIG. 11B is an enlarged view showing the voltage variation of the neighborhood of the peak of the AC component.

COLUMN 2:

Line 18, "FIG. 11(b)," should read --FIG. 11B,--.
Line 39, "appears" should read --appear--.
Line 41, "occurs," should read --occur,--.

COLUMN 3:

Line 5, "wave form" should read --waveform--.
Line 12, "wave" should read --wave- --.
Line 27, "wave form" should read --waveform--.
Line 43, "wave form" should read --waveform--.

UNITED STATES PATENT AND TRADEMARK OFFICE

CERTIFICATE OF CORRECTION

PATENT NO. : 5,412,455

DATED : May 2, 1995

INVENTOR(S) : Kazuaki ONO, et al.

It is certified that error appears in the above-indentified patent and that said Letters Patent is hereby corrected as shown below:

COLUMN 6:

Line 18, "Sine" should read --sine--.
Line 42, "times" should read --times that--.

COLUMN 7:

Line 16, "wave form" should read --waveform--.

COLUMN 8:

Line 10, "For" should read --for--.
Line 15, "a" should read --an--.
Line 21, ".the" should read --the--.
Line 36, "times" should read --times that--.

COLUMN 9:

Line 32, "2" should be deleted.
Line 43, "be" should read --is--.

UNITED STATES PATENT AND TRADEMARK OFFICE

CERTIFICATE OF CORRECTION

PATENT NO. : 5,412,455

DATED : May 2, 1995

INVENTOR(S) : Kazuaki ONO, et al.

It is certified that error appears in the above-indentified patent and that said Letters Patent is hereby corrected as shown below:

COLUMN 10:

Line 3, "FIG. 3(a)," should read --FIG. 3A,--.
Line 11, "FIG. 3(b)," should read --FIG. 3B,--.
Line 62, "FIG. 3(a)" should read --FIG. 3A--.
Line 66, "FIG. 3(a)" should read --FIG. 3A--.

COLUMN 11:

Line 30, "FIG. 6(a)" should read --FIG. 6A--.
Line 37, "as" should read --is as--; and "FIG. 6(b)." should read --FIG. 6B.--.
Line 38, "wave form" should read --waveform--.

COLUMN 13:

Line 51, "charged;" should read --charged; and--.

UNITED STATES PATENT AND TRADEMARK OFFICE

CERTIFICATE OF CORRECTION

PATENT NO. : 5,412,455

DATED : May 2, 1995

INVENTOR(S) : Kazuaki ONO, et al.

It is certified that error appears in the above-indentified patent and that said Letters Patent is hereby corrected as shown below:

COLUMN 14:

Line 4, "and" should read --and said--.
Line 5, "charged;" should read --charged; and--.
Line 10, "comprising" should read --comprises--.
Line 20, "charged;" should read --charged; and--.
Line 38, "con-" should be deleted.
Line 39, "stant voltage element is" should be deleted.

Signed and Sealed this

Twenty-second Day of August, 1995

Bruce Lehman

*Attest:*

BRUCE LEHMAN

*Attesting Officer*

*Commissioner of Patents and Trademarks*